US005078280A

United States Patent [19]

Nordeen

[11] Patent Number: 5,078,280

[45] Date of Patent: Jan. 7, 1992

[54] MAGNETIC KEEPER SHELF

[75] Inventor: Ryan C. Nordeen, East Greenwich, R.I.

[73] Assignee: Hoechst-Roussel Pharmaceutical Incorporated, Somerville, N.J.

[21] Appl. No.: 673,561

[22] Filed: Mar. 22, 1991

[51] Int. Cl.[5] ..... A47F 5/00

[52] U.S. Cl. ..... 211/86; 280/32.6; 211/DIG. 1; 248/683

[58] Field of Search ..... 211/86, 153, DIG. 1, 211/70.6; 248/220.2, 206.5, 683, 220.1; 280/32.6, 79.11

[56] References Cited

U.S. PATENT DOCUMENTS

| | | | |
|---|---|---|---|
| 152,008 | 12/1948 | Lucas | 280/32.6 |
| 1,431,383 | 10/1922 | Edwards | 280/32.6 |
| 2,487,706 | 11/1949 | Happ | 280/32.6 |
| 2,642,999 | 6/1953 | McPherson | 211/DIG. 1 X |
| 2,919,086 | 12/1959 | McMahan | 248/206.5 X |
| 3,021,104 | 2/1962 | Keller | 248/220.1 |
| 3,110,917 | 11/1963 | McPeek, Jr. | 248/683 |
| 4,518,138 | 5/1985 | Stutenkemper et al. | 248/220.2 X |
| 4,792,051 | 12/1988 | Miller | 211/DIG. 1 X |
| 4,899,894 | 2/1990 | Crump | 211/DIG. 1 X |

*Primary Examiner*—Carl D. Friedman
*Assistant Examiner*—Korie H. Chan
*Attorney, Agent, or Firm*—Elliott Korsen

[57] ABSTRACT

An improvement in a mechanic's creeper whereby a Z-shaped shelf member with a powerful magnet is attached to an edge of the creeper. The shelf member with its magnet holds tools in such a way that the tools can be readily accessible to the mechanic.

5 Claims, 2 Drawing Sheets

MAGNETIC KEEPER SHELF

BACKGROUND OF THE INVENTION AND PRIOR ART

Creepers to assist a mechanic by providing a comfortable sliding surface beneath an automobile or some inaccessible place have been used by the novice and professional automobile mechanic for years. The creepers provide an improved working relationship between the mechanic and the workplace by facilitating movement of the mechanic. The prior art creepers have been modified in many ways to improve the convenience and comfort of the mechanic.

In U.S. Pat. Nos. 1,104,398 and 2,291,094, appendages to retain tools for the mechanic are included. In U.S. Pat. No. 4,795,180, a mobile tool caddy is disclosed which may or may not be connected to the creeper itself.

In most underneath the auto mechanical service, the mechanic will choose the desired tools, use a creeper to travel under the car and place the tools adjacent the creeper on the floor. Movement of the mechanic beneath the auto causes his tools to be displaced and inaccessible to the reach. Additionally, any small hardware that he has removed from the car may also be displaced or become dirty and greasy. Much time is wasted searching on the floor for tools and for nuts, bolts and other small objects which are used.

One object of this invention is to provide a magnetic keeper shelf which will keep metal tools in place at arms reach while working on a creeper.

Another object of this invention is to provide a magnetic keeper shelf which will enable the mechanic employing such a device in connection with a creeper to pick up dropped tools or hardware by moving over these items and having them picked up by the magnet located on the underside of the shelf.

SUMMARY OF THE INVENTION

The present invention provides a shelf that permits a mechanic to maintain his tools and other metal hardware by his side within reach and additionally prevents the displacement of any metal tools or hardware by the use of a powerful magnet. The magnet is also useful for picking up any tools or small hardware that may be dropped underneath the vehicle.

BRIEF DESCRIPTION OF THE DRAWING

The invention is illustrated in the drawing wherein.

DETAILED DESCRIPTION OF THE INVENTION

Referring more particularly to the drawings, wherein like numbers designate like parts throughout, the number 10 designates generally the creeper portion and the number 18 designates generally the magnetic keeper shelf portion of the invention.

Figure 1:
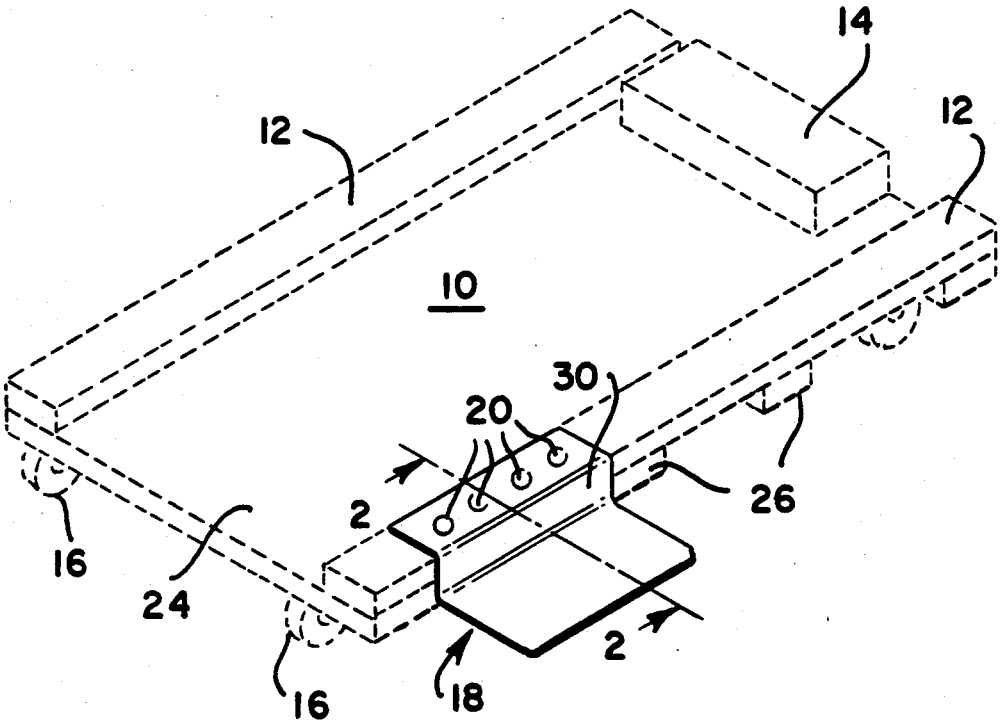
FIG. 1 is an isometric view of a creeper with the shelf attached at one end.
Figure 2:
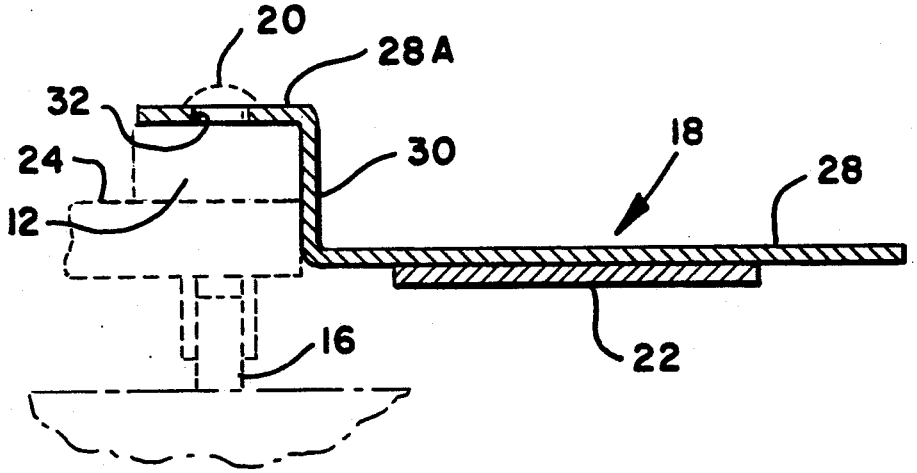
FIG. 2 is an enlarged vertical sectional view taken along line A—A of FIG. 1.

Referring to FIG. 1, the creeper 10 includes a rectangular support surface 24. Attached to the top side of the support surface 24, along the longitudinal edges thereof, are elongated side strip members 12. Also attached to the top side of the support surface 24, and adjacent the front end thereof, is a head rest pad 14. Several transverse or cross bar supports 26 are spaced apart and attached to the underside of the support surface 24. Four caster or wheel structures 16 also are attached to the underside of the support structure 24.

The shelf 18 more particularly includes a horizontal surface 28 and a magnet or plurability of magnets 22 attached to the underside of this surface 28. The shelf is attached to the elongated side strip member 12 by a plurality of mounting means 20 which are spaced along the short horizontal surface **28*a* which contains a plurality of openings 32 for the mounting means to pass through to hold the shelf 18 on the creeper. The mounting means 20 may go through both the elongated side strip member 12 and the rectangular support surface 24 to secure the shelf 18 to the creeper 10**.

The vertical surface of the shelf 30 can be manufactured such that the horizontal surface 28 is at the same level as or lower than the bottom of the rectangular support surface 24 of the creeper. The length of the vertical surface 30 is determined by the strength of the magnet 22.

Figure 3:
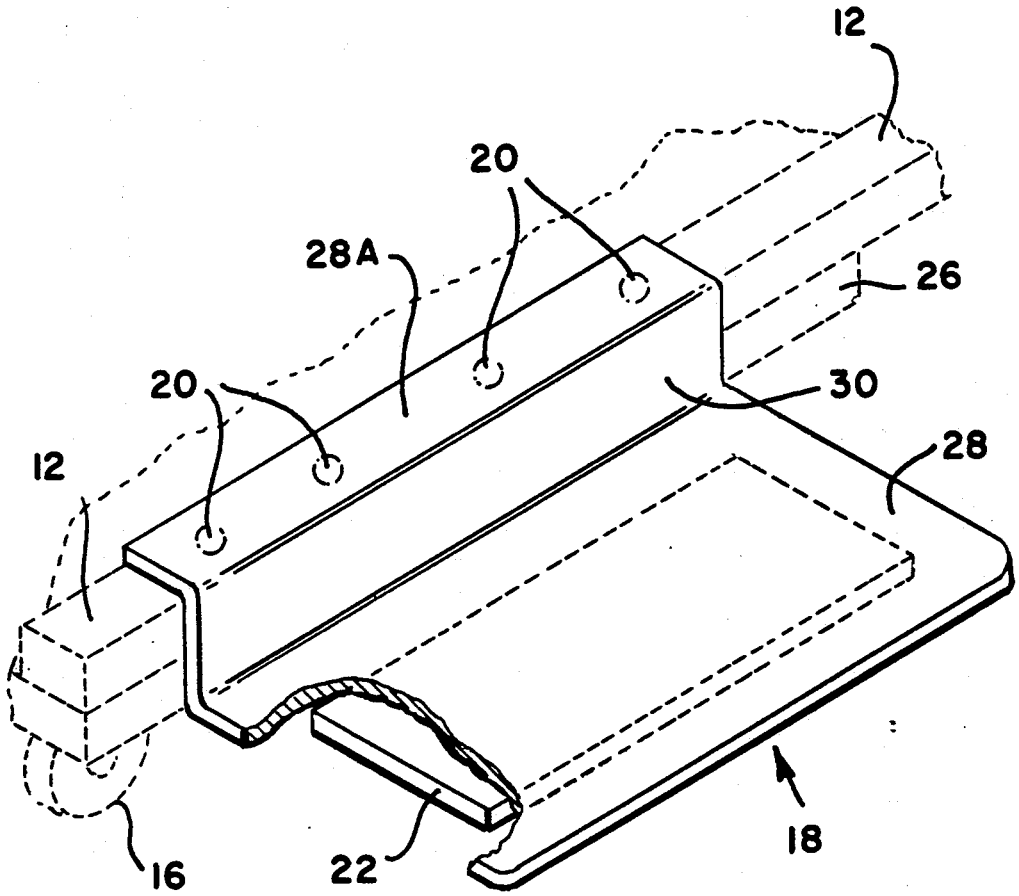
FIG. 3 is an enlarged cut away view of the shelf with a bar-type magnet attached to the bottom.

As best shown in FIG. 3, the magnet 22 is attached to the bottom surface of the horizontal surface 28 by suitable glues, cements or other adhesives known to the art. Optionally, the magnet or plurality of magnets can be embedded in the horizontal surface 28 of the shelf. The plurality of mounting means 20 attaching the shelf 18 to the creeper assembly 10 can be secured to the underside of the rectangular support surface 24 by nuts or other suitable means.

The magnet 22 may be a single piece or a plurality of pieces depending on availability. The preferred embodiment contains a single rectangular bar magnet.

The shelf assembly can be made from a number of materials including sheet metal, in which case the magnet will not need to be attached by other means; injection molded or otherwise thermoformed recycled thermoplastic products, polypropylene, polyethylene, polyacetal, nylon or other suitable materials known in the art.

The shelf may be permanently attached to the creeper by rivets, nuts and bolts, screws, nails or other suitable attaching means. Alternatively, the shelf may be removable and able to be attached on either side of the creeper. In this embodiment, the shelf may be removed and switched from one side of the creeper to the other depending on the mechanic's preference.

Further in the removable embodiment, the shelf may be attached by an assortment of attaching means which would facilitate the removal of the shelf when not needed or the switching of the shelf from one side of the creeper to the other. Such types of attaching means which are contemplated include nuts and bolts, cotter pins, tabs, wing nuts or any other means which would facilitate quick removability.

Furthermore, the creeper may be modified such that the elongated side strip members 12 contain horizontal grooves in which the short horizontal surface **28*a*** can be slid in order to hold the shelf.

The shelf assembly itself, in its perferred embodiment, is a single piece that is bent by machine such that the horizontal surfaces 28 and **28*a* are at approximately right angles to the vertical surface 30, said vertical surface being against the sides of the creeper itself. The horizontal surface 28 and 28***a* would be on different sides of the vertical surface.

The shelf assembly will preferably be made of a material such that the total weight of the shelf, magnet and tools or hardware supported by the shelf, will not cause the material to further bend and distort.

If the magnetic keeper shelf 18 is made of a non-metallic component, the magnet 22 or plurality of magnets can be attached using suitable glues or cements known to the art. Preferably, the magnet or plurality of magnets is embedded in the non-metallic horizontal surface 28 of the magnetic keeper shelf by means known to the art.

The length of the vertical surface 30 of the magnetic keeper shelf is determined by the strength of the magnet 22 or plurality of magnets being employed in the invention. Preferably the magnet will be of such strength so that the larger, horizontal surface 28 of the magnetic keeper shelf 18 is at the same height off the ground as the bottom of the rectangular support surface 24. The larger horizontal surface 28 can be closer to the ground if the magnets employed are not able to pick up dropped tools or hardware while at the same height as the bottom of the rectangular support surface 24.

Other possible embodiments of the invention include those described below, however, it is to be understood that further modifications and alternatives may be had without departing from the spirit and scope of the invention as defined in the appended claims.

For example, the shelf may contain rims around the three sides in order to better hold the tools or hardware on top of it.

Another possible embodiment of this invention is to form the shelf of a material that can be magnetized without the need of attaching a magnet to the shelf.

Optionally, the shelf can be an L-shaped material with the plurality of openings for attachment to the creeper on the vertical portion of the L. In this embodiment, the shelf can be attached to the creeper by any of the aforementioned means.

What is claimed is:

1. A shelf in combination with a conventional creeper for working beneath a vehicle or other inaccessible work places comprising a first horizontal surface said horizontal surface bending at an angle to form a vertical surface, said vertical surface bending at an angle to form a second horizontal surface, such that the first and second horizontal surfaces are on different sides of the vertical surface, and the first horizontal surface extends beyond an edge of said creeper, means for attaching said shelf to said edge of said creeper, and a magnet or plurality of magnets located on the underside of said first horizontal surface.

2. The shelf in combination with a creeper as defined in claim 1 wherein the second horizontal surface contains a plurality of openings.

3. The shelf in combination with a creeper as defined in claim 1 wherein the attaching means include nuts and bolts, screws, cotter pins or other suitable attaching pins.

4. The shelf in combination with a creeper as defined in claim 1 wherein the magnet is a single bar magnet.

5. The shelf in combination with a creeper as defined in claim 1 which is permanently attached to the creeper.

* * * * *